US012662725B2

(12) United States Patent
Endo et al.

(10) Patent No.: US 12,662,725 B2
(45) Date of Patent: Jun. 23, 2026

(54) STAINLESS STEEL SEAMLESS PIPE FOR OIL COUNTRY TUBULAR GOODS AND METHOD FOR MANUFACTURING THE SAME

(71) Applicant: JFE Steel Corporation, Tokyo (JP)

(72) Inventors: Mami Endo, Tokyo (JP); Kenichiro Eguchi, Tokyo (JP); Mitsuhiro Okatsu, Tokyo (JP); Masao Yuga, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 389 days.

(21) Appl. No.: 17/799,339

(22) PCT Filed: Mar. 25, 2021

(86) PCT No.: PCT/JP2021/012700
§ 371 (c)(1),
(2) Date: Aug. 12, 2022

(87) PCT Pub. No.: WO2021/235087
PCT Pub. Date: Nov. 25, 2021

(65) Prior Publication Data

US 2023/0107887 A1 Apr. 6, 2023

(30) Foreign Application Priority Data

May 18, 2020 (JP) ..... 2020-086402

(51) Int. Cl.

| | |
|---|---|
| ***C22C 38/60*** | (2006.01) |
| ***C21D 6/00*** | (2006.01) |
| ***C21D 9/08*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |

(52) U.S. Cl.
CPC ..... *C22C 38/60* (2013.01); *C21D 6/004* (2013.01); *C21D 6/005* (2013.01); *C21D 6/007* (2013.01); *C21D 6/008* (2013.01); *C21D 9/085* (2013.01); *C22C 38/001* (2013.01); *C22C 38/002* (2013.01); *C22C 38/004* (2013.01); *C22C 38/005* (2013.01); *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C21D 2211/008* (2013.01)

(58) Field of Classification Search
CPC ..... C10M 107/02; C10M 125/02; C10M 169/04; C10M 173/00; C10M 2201/02; C10M 2201/041; C10M 2201/14; C10M 2203/1006; C10M 2205/0206; C10N 2020/06; C10N 2030/04; C10N 2030/06
See application file for complete search history.

(56) References Cited

U.S. PATENT DOCUMENTS

| | | | | |
|---|---|---|---|---|
| 2005/0224143 | A1 | 10/2005 | Takabe et al. | |
| 2009/0162239 | A1 | 6/2009 | Takabe et al. | |
| 2019/0055617 | A1 | 2/2019 | Okatsu et al. | |
| 2019/0136337 | A1* | 5/2019 | Eguchi | C22C 38/22 |
| 2019/0177823 | A1 | 6/2019 | Matsuo et al. | |
| 2020/0270715 | A1 | 8/2020 | Endo et al. | |
| 2020/0283866 | A1* | 9/2020 | Endo | C22C 38/46 |

(Continued)

FOREIGN PATENT DOCUMENTS

| | | | |
|---|---|---|---|
| CN | 106414785 | A | 2/2017 |
| CN | 109563581 | A | 4/2019 |
| EP | 3121306 | A1 | 1/2017 |

(Continued)

OTHER PUBLICATIONS

International Search Report and Written Opinion for International Application No. PCT/JP2021/012700, dated Jun. 21, 2021, 6 pages.
Chinese Office Action for Chinese Application No. 202180015082.5, dated May 18, 2023 with Concise Statement of Relevance of Office Action, 7 pages.
Extended European Search Report for European Application No. 21 808 119.8, dated May 12, 2023, 14 pages.
"Principles and Processes of Electric Furnace Steelmaking," Jul. 31, 2001, 6 pages with translation, Metallurgy Industry Press.
Chinese Office Action for Chinese Application No. 202180015082.5, dated Oct. 30, 2023 with Concise Statement of Relevance of Office Action, 9 pages.

(Continued)

*Primary Examiner* — Jenny R Wu
(74) *Attorney, Agent, or Firm* — Buchanan Ingersoll & Rooney PC

(57) ABSTRACT

Provided herein is a stainless steel seamless pipe for oil country tubular goods. A method for manufacturing such a stainless steel seamless pipe is also provided. The stainless steel seamless pipe has: a composition that contains, in mass %, C: 0.10% or less, Si: 0.5% or less, Mn: 0.05 to 0.50%, P: 0.030% or less, S: 0.005% or less, O: 0.0040% or less, Ni: 3.0 to 8.0%, Cr: 10.0 to 14.0%, Mo: 0.5 to 2.8%, Al: 0.1% or less, V: 0.005 to 0.2%, N: 0.10% or less, Cu: 0.01 to 1.0%, Co: 0.01 to 1.0%, and Ca: 0.0005 to 0.0030%, and in which the balance is Fe and incidental impurities; a microstructure containing at most 20 non-metallic inclusions having a predetermined composition ratio of CaO and $Al_2O_3$ and a major axis of 5 μm or more per 100 $mm^2$; and a yield stress of 655 MPa or more.

8 Claims, No Drawings

(56) References Cited

U.S. PATENT DOCUMENTS

2020/0407814 A1 12/2020 Endo et al.

FOREIGN PATENT DOCUMENTS

| | | | | | |
|---|---|---|---|---|---|
| EP | 3 568 | A1 | | 3/2019 | |
| EP | 3690074 | A1 | | 8/2020 | |
| EP | 3767000 | A1 | | 1/2021 | |
| EP | 3805420 | A1 | | 4/2021 | |
| EP | 3845680 | A1 | | 7/2021 | |
| JP | 2002060893 | A | | 2/2002 | |
| JP | 2003003243 | A | * | 1/2003 | |
| JP | 2010242163 | A | | 10/2010 | |
| WO | 2004057050 | A1 | | 7/2004 | |
| WO | 2008023702 | A1 | | 2/2008 | |
| WO | 2017149572 | A1 | | 9/2017 | |
| WO | WO-2017168874 | A1 | * | 10/2017 | ..... C22C 38/005 |
| WO | 2017200083 | A1 | | 11/2017 | |
| WO | 2019065115 | A1 | | 4/2019 | |
| WO | 2019065116 | A1 | | 4/2019 | |
| WO | WO-2019065114 | A1 | * | 4/2019 | ..... C21D 1/22 |
| WO | 2019225280 | A1 | | 11/2019 | |
| WO | 2019225281 | A1 | | 11/2019 | |
| WO | 2020095559 | A1 | | 5/2020 | |

OTHER PUBLICATIONS

Chinese Office Action with Search Report for Chinese Application No. 202180015082.5, dated Aug. 9, 2023, 13 pages.

Chinese Office Action with Search Report for Chinese Application No. 202180015082.5, dated Feb. 16, 2023, 10 pages.

Japanese Office Action for Japanese Application No. 2021-544278, dated Jul. 12, 2022 with Concise Statement of Relevance of Office Action, 4 pages.

* cited by examiner

STAINLESS STEEL SEAMLESS PIPE FOR OIL COUNTRY TUBULAR GOODS AND METHOD FOR MANUFACTURING THE SAME

CROSS REFERENCE TO RELATED APPLICATIONS

This is the U.S. National Phase application of PCT/JP2021/012700, filed Mar. 25, 2021, which claims priority to Japanese Patent Application No. 2020-086402, filed May 18, 2020, the disclosures of these applications being incorporated herein by reference in their entireties for all purposes.

FIELD OF THE INVENTION

The present invention relates to a stainless steel seamless pipe for oil country tubular goods used for crude oil wells or natural gas wells (hereinafter, referred to simply as oil wells), and to a method for manufacturing such a stainless steel seamless pipe. Specifically, the present invention relates to a stainless steel seamless pipe for oil country tubular goods having a yield stress, YS, of 655 MPa or more, and excellent sulfide stress corrosion cracking resistance (SSC resistance) in environments containing hydrogen sulfide ($H_2S$), and to a method for manufacturing such a stainless steel seamless pipe.

BACKGROUND OF THE INVENTION

Increasing crude oil prices and an expected shortage of petroleum resources in the near future have prompted active development of oil fields and gas fields that were unthinkable in the past, for example, such as deep oil fields, and oil fields and gas fields of severe corrosive environments containing carbon dioxide gas, chlorine ions, and hydrogen sulfide. Steel pipes for oil country tubular goods to be used in such environments are required to have high strength and excellent corrosion resistance.

Oil country tubular goods used for extraction in oil fields and gas fields in an environment containing carbon dioxide gas, chlorine ions, and the like often use 13% Cr martensitic stainless steel pipes. The recent global development of oil fields of very severe corrosive environments containing hydrogen sulfide has created a demand for oil country tubular goods having SSC resistance.

PTL 1 describes a 13% Cr-base martensitic stainless steel pipe of a composition system having an ultra low C content of 0.015% or less, and a Ti content of 0.03% or more, in mass %. The steel pipe is described as having excellent SSC resistance while providing high strength with a yield stress in a 95 ksi class, and low hardness with an HRC of less than 27.

PTL 2 describes a martensitic stainless steel satisfying $6.0 \leq Ti/C \leq 10.1$, noting that Ti/C has a correlation with a value obtained by subtracting a yield stress from a tensile stress. It is stated in PTL 2 that the technique can provide a steel having a value of 20.7 MPa or more as the difference of yield stress from tensile stress, and having reduced variation in hardness that decreases the SSC resistance when there is variation.

PTL 3 describes a steel for oil country tubular goods having excellent sulfide stress corrosion cracking resistance. The steel comprises, in mass %, C: 0.15 to 0.35%, Si: 0.1 to 1.5%, Mn: 0.1 to 2.5%, P: 0.025% or less, S: 0.004% or less, sol.Al: 0.001 to 0.1%, and Ca: 0.0005 to 0.005%, and defines the composition of Ca-base non-metallic inclusions, complex oxides of Ca and Al, and the HRC hardness of steel.

PTL 4 describes a martensitic stainless steel that defines the Mo content of steel by $Mo \geq 2.3-0.89Si+32.2C$, and that has a metal microstructure of primarily tempered martensite, carbides precipitated during tempering, and fine precipitates of intermetallic compounds formed during tempering, such as the Laves phase and 6 phase. It is stated in PTL 4 that the technique can provide the steel having high strength with a 0.2% proof stress of 860 MPa or more, and having excellent carbon dioxide gas corrosion resistance and sulfide stress corrosion cracking resistance.

PATENT LITERATURE

PTL 1: JP-A-2010-242163
PTL 2: WO2008/023702
PTL 3: JP-A-2002-60893
PTL 4: WO2004/057050

SUMMARY OF THE INVENTION

Today's oil fields and gas fields are developed in severe corrosive environments containing $CO_2$, $Cl^-$, and $H_2S$. Increase in $H_2S$ concentration due to aging of oil fields and gas fields is also of concern. Steel pipes for oil country tubular goods used in such environments are required to have excellent sulfide stress corrosion cracking resistance.

It is stated in PTL 1 that sulfide stress corrosion cracking resistance can be maintained under an applied stress of 655 MPa in an atmosphere of a 5% NaCl aqueous solution ($H_2S$: 0.10 bar) having an adjusted pH of 3.5. It is stated in PTL 2 that the steel has sulfide stress corrosion cracking resistance in an atmosphere of a 20% NaCl aqueous solution ($H_2S$: 0.03 bar, $CO_2$ bal.) having an adjusted pH of 4.5. It is stated in PTL 3 that the steel has sulfide stress corrosion cracking resistance under an applied stress of 85% of the minimum yield stress in an atmosphere of a 5% NaCl aqueous solution ($H_2S$: 1 bar). It is stated in PTL 4 that the steel has sulfide stress corrosion cracking resistance in an atmosphere of a 25% NaCl aqueous solution ($H_2S$: 0.03 bar, $CO_2$ bal.) having an adjusted pH of 4.0. However, PTL 1 to PTL 4 give no consideration to sulfide stress corrosion cracking resistance in environments other than those above, and it cannot be said that the sulfide stress corrosion cracking resistance is high enough to withstand today's more severe corrosive environments.

It is accordingly an object according to aspects of the present invention to provide a stainless steel seamless pipe for oil country tubular goods having a yield stress of 655 MPa (95 ksi) or more, and excellent sulfide stress corrosion cracking resistance. Aspects of the present invention are also intended to provide a method for manufacturing such a stainless steel seamless pipe.

As used herein, "excellent sulfide stress corrosion cracking resistance" means that a test specimen immersed in a 25° C. test solution (a 25 mass % NaCl+0.5 mass % $CH_3COOH$ aqueous solution saturated with 0.1 bar $H_2S$ ($CO_2$ bal.) and having an adjusted pH of 4.0 by addition of $CH_3COONa$) has no cracks after being kept in the solution for 720 hours under an applied stress of 90% of the yield stress.

In order to achieve the foregoing objects, the present inventors conducted intensive investigations of various factors that affect the sulfide stress corrosion cracking resistance (SSC resistance) in $CO_2$—, $Cl^-$—, and $H_2S$-containing corrosive environments, using the basic composition of a 13% Cr-base stainless steel pipe. The studies found that a stainless steel seamless pipe for oil country tubular goods having desired strength and having excellent SSC resistance in a $CO_2$—, $Cl^-$—, and $H_2S$-containing corrosive environment under an applied stress close to the yield stress can be achieved by confining the content of each component within the predetermined range, and by restricting the inclusions that become an initiation site of SSC.

Aspects of the present invention were completed after further studies based on these findings, and are as follows.

[1] A stainless steel seamless pipe for oil country tubular goods having:

a composition that contains, in mass %, C: 0.10% or less, Si: 0.5% or less, Mn: 0.05 to 0.50%, P: 0.030% or less, S: 0.005% or less, O: 0.0040% or less, Ni: 3.0 to 8.0%, Cr: 10.0 to 14.0%, Mo: 0.5 to 2.8%, Al: 0.1% or less, V: 0.005 to 0.2%, N: 0.10% or less, Cu: 0.01 to 1.0%, Co: 0.01 to 1.0%, and Ca: 0.0005 to 0.0030%, and in which the balance is Fe and incidental impurities;

a microstructure containing non-metallic inclusions of an oxide containing calcium oxide, CaO, and aluminum oxide, $Al_2O_3$, in the steel, wherein a number of the non-metallic inclusions in the steel having a composition ratio satisfying the formula (1) below and a major axis of 5 μm or more is at most 20 per 100 $mm^2$; and a yield stress of 655 MPa or more, $$(CaO)/(Al_2O_3) \geq 4.0 \quad (1),$$

where (CaO) and ($Al_2O_3$) in formula (1) represent the content of CaO and the content of $Al_2O_3$ in the non-metallic inclusions in the steel, in mass %.

[2] The stainless steel seamless pipe for oil country tubular goods according to [1], wherein the composition further contains, in mass %, one or two or more selected from Ti: 0.50% or less, Nb: 0.50% or less, W: 1.0% or less, Ta: 0.1% or less, and Zr: 0.20% or less.

[3] The stainless steel seamless pipe for oil country tubular goods according to [1] or [2], wherein the composition further contains, in mass %, one or two or more selected from REM: 0.010% or less, Mg: 0.010% or less, B: 0.010% or less, Sb: 0.20% or less, and Sn: 0.20% or less.

[4] A method for manufacturing the stainless steel seamless pipe for oil country tubular goods of any one of [1] to [3], the method including:

forming a steel pipe material of said composition into a steel pipe;

quenching in which the steel pipe is heated to a temperature equal to or greater than an $A_{c3}$ transformation point, and is cooled to a cooling stop temperature of 100° C. or less; and tempering in which the steel pipe is tempered at a temperature equal to or less than an $A_{c1}$ transformation point.

Aspects of the present invention can provide a stainless steel seamless pipe for oil country tubular goods having excellent sulfide stress corrosion cracking resistance (SSC resistance) in $CO_2$—, $Cl^-$—, and $H_2S$-containing corrosive environments, and having high strength with a yield stress (YS) of 655 MPa (95 ksi) or more.

DETAILED DESCRIPTION OF EMBODIMENTS OF THE INVENTION

The following describes the reasons for limiting the composition of a stainless steel seamless pipe for oil country tubular goods according to aspects of the present invention (hereinafter, also referred to simply as "steel pipe according to aspects of the present invention"). In the following, "%" means percent by mass, unless otherwise specifically stated.

C: 0.10% or Less

C is an important element involved in the strength of stainless steel, and is effective for improving strength. However, with a C content of more than 0.10%, the hardness overly increases, and the steel becomes more susceptible to sulfide stress corrosion cracking. For this reason, the C content is limited to 0.10% or less. The C content is preferably 0.08% or less. A C content of 0.003% or more is desirable for providing desired strength.

Si: 0.5% or Less

Si acts as a deoxidizing agent, and is contained desirably in an amount of 0.05% or more. A Si content of more than 0.5% decreases carbon dioxide gas corrosion resistance and hot workability. For this reason, the Si content is limited to 0.5% or less. In view of more stably providing desired strength, the Si content is more preferably 0.10% or more. The Si content is preferably 0.30% or less.

Mn: 0.05 to 0.50%

Mn is an element that improves strength, and a Mn content of 0.05% or more is needed to obtain desired strength. The effect becomes saturated with a Mn content of more than 0.50%, and this leads to cost increase. For this reason, the Mn content is limited to 0.05 to 0.50%. The Mn content is preferably 0.40% or less.

P: 0.030% or Less

P is an element that decreases carbon dioxide gas corrosion resistance, pitting corrosion resistance, and sulfide stress corrosion cracking resistance, and is contained desirably in as small an amount as possible in accordance with aspects of the present invention. However, an excessively low P content increases the manufacturing cost. For this reason, the P content is limited to 0.030% or less, a range that is industrially implementable at low costs without causing a serious decrease in properties. The P content is preferably 0.020% or less. The lower limit of P content is not particularly limited. However, the lower limit of P content is preferably about 0.010% because excessive dephosphorization leads to increase in manufacturing cost.

S: 0.005% or Less

S is an element that causes a serious decrease in hot workability, and is contained desirably in as small an amount as possible. The S content is limited to 0.005% or less in accordance with aspects of the present invention because pipe production using an ordinary process is possible with a S content of 0.005% or less. The S content is preferably 0.002% or less. The lower limit of S content is not particularly limited. However, the lower limit of S content is preferably about 0.001% because excessive desulfurization leads to increase in manufacturing cost.

O: 0.0040% or Less

Oxygen in steel exists as oxides of elements such as Al and Ca, in the form of incidental impurities. When present in large numbers, these coarse oxides become an initiation site of pitting corrosion, and impair the sulfide stress corrosion cracking resistance. For this reason, the O content is limited to 0.0040% or less, a tolerable range against such adverse effects. The O content is preferably 0.0025% or less. The lower limit of O content is not particularly limited. However, the lower limit of O content is preferably about 0.0005% because excessive deoxidization leads to increase in manufacturing cost.

Ni: 3.0 to 8.0%

Ni is an element that improves corrosion resistance by strengthening the protective coating. Ni is also an element that increases steel strength. Ni needs to be contained in an amount of 3.0% or more to obtain these effects. A Ni content of more than 8.0% decreases the stability of martensitic phase, and the strength decreases. For this reason, the Ni content is limited to 3.0 to 8.0%. The Ni content is preferably 3.5% or more. The Ni content is preferably 7.5% or less.

Cr: 10.0 to 14.0%

Cr is an element that improves the corrosion resistance by forming a protective coating, and can provide the corrosion resistance necessary for oil country tubular goods when contained in an amount of 10.0% or more. A Cr content of more than 14.0% facilitates ferrite formation, and stability cannot be provided for the martensitic phase. For this reason, the Cr content is limited to 10.0 to 14.0%. The Cr content is preferably 11.0% or more. The Cr content is preferably 13.5% or less.

Mo: 0.5 to 2.8%

Mo is an element that improves the resistance against pitting corrosion due to $Cl^-$. Mo needs to be contained in an amount of 0.5% or more to obtain the corrosion resistance necessary in severe corrosive environments. Mo is an expensive element, and a Mo content of more than 2.8% leads to increase in manufacturing cost. For this reason, the Mo content is limited to 0.5 to 2.8%. The Mo content is preferably 1.0% or more. The Mo content is preferably 2.5% or less.

Al: 0.1% or Less

Al acts as a deoxidizing agent, and is contained in an amount of 0.01% or more to obtain this effect. The Al content is limited to 0.1% or less in accordance with aspects of the present invention because an Al content of more than 0.1% has adverse effects on toughness. The Al content is preferably 0.01% or more. The Al content is preferably 0.05% or less.

V: 0.005 to 0.2%

V improves the strength of steel by precipitation hardening, in addition to improving sulfide stress corrosion cracking resistance. V needs to be contained in an amount of 0.005% or more for these effects. The V content is limited to 0.005 to 0.2% in accordance with aspects of the present invention because a V content of more than 0.2% decreases toughness. The V content is preferably 0.008% or more. The V content is preferably 0.1% or less.

N: 0.10% or Less

N acts to increase strength by forming a solid solution in steel, in addition to improving pitting corrosion resistance. However, a N content of more than 0.10% leads to formation of large numbers of various nitride inclusions, and the pitting corrosion resistance decreases. For this reason, the N content is limited to 0.10% or less. The N content is preferably 0.070% or less. The lower limit is not particularly limited. However, the lower limit of N content is preferably about 0.0030% because excessive denitrification leads to increase in manufacturing cost.

Cu: 0.01 to 1.0%

Cu improves sulfide stress corrosion cracking resistance by strengthening the protective coating. Cu is contained in an amount of 0.01% or more to obtain this effect. However, a Cu content of more than 1.0% leads to precipitation of CuS, and decreases hot workability. For this reason, the Cu content is limited to 0.01 to 1.0%. The Cu content is preferably 0.03% or more. The Cu content is preferably 0.6% or less.

Co: 0.01 to 1.0%

Co is an element that decreases hardness by raising the Ms point and promoting a transformation, in addition to improving pitting corrosion resistance. Co needs to be contained in an amount of 0.01% or more to obtain these effects. An excessively high Co content may lead to decrease in toughness, and this adds to the material cost. For this reason, the Co content is limited to 0.01 to 1.0%. The Co content is preferably 0.60% or less.

Ca: 0.0005 to 0.0030%

Ca is effective for preventing clogging of nozzles during continuous casting. Ca needs to be contained in an amount of 0.0005% or more to obtain this effect. A Ca content of more than 0.0030% leads to formation of coarse oxides, and decreases the sulfide stress corrosion cracking resistance. For this reason, the Ca content is limited to 0.0005 to 0.0030%. The Ca content is preferably 0.0020% or less.

A steel pipe according to aspects of the present invention preferably has a composition that contains the foregoing components, and in which the balance is Fe and incidental impurities.

A steel pipe according to aspects of the present invention may contain one or two selected from the following groups A and B, in addition to the foregoing components.

Group A:

One or two or more selected from Ti: 0.50% or less, Nb: 0.50% or less, W: 1.0% or less, Ta: 0.1% or less, and Zr: 0.20% or less Group B:

One or two or more selected from REM: 0.010% or less, Mg: 0.010% or less, B: 0.010% or less, Sb: 0.20% or less, and Sn: 0.20% or less One or Two or More Selected from Ti: 0.50% or Less, Nb: 0.50% or Less, W: 1.0% or Less, Ta: 0.1% or Less, and Zr: 0.20% or Less Ti and Nb can reduce hardness by forming carbides and reducing solid-solution carbon. When contained in excessively large amounts, Ti forms TiN, and impairs the sulfide stress corrosion cracking resistance. For this reason, Ti, when contained, is contained in an amount of 0.50% or less. When Ti is contained, the Ti content is preferably 0.001% or more, more preferably 0.010% or more. An excessively high Nb content may lead to decrease in toughness. For this reason, Nb, when contained, is contained in an amount of 0.50% or less. When Nb is contained, the Nb content is preferably 0.002% or more. W is an element that improves the pitting corrosion resistance. However, an excessively high W content may lead to decrease in toughness, and increased material costs. For this reason, W, when contained, is contained in an amount of 1.0% or less. When W is contained, the W content is preferably 0.050% or more. Ta is an element that increases strength, and has the effect to improve sulfide stress cracking resistance. Ta also has effects similar to the effects produced by Nb, and Nb may be partly replaced by Ta. A Ta content of more than 0.1% decreases toughness. For this reason, Ta, when contained, is contained in an amount of 0.1% or less. When Ta is contained, the Ta content is preferably 0.01% or more. Zr is an element that contributes to increasing strength, and may be contained as required. However, the effect becomes saturated with a Zr content of more than 0.20%. For this reason, Zr, when contained, is contained in an amount of 0.20% or less. When Zr is contained, the Zr content is preferably 0.01% or more.

One or Two or More Selected from REM: 0.010% or Less, Mg: 0.010% or Less, B: 0.010% or Less, Sb: 0.20% or Less, and Sn: 0.20% or Less REM (Rare Earth Metals), Mg, and B are elements that improve the corrosion resistance by controlling the shape of inclusions. Preferably, the REM, Mg, and B contents are REM: 0.0005% or more, Mg: 0.0005% or more, and B:

0.0005% or more to obtain this effect. Toughness and carbon dioxide gas corrosion resistance decrease when the contents of REM, Mg, and B are REM: more than 0.010%, Mg: more than 0.010%, and B: more than 0.010%. For this reason, when REM, Mg, and B are contained, the REM, Mg, and B contents are limited to REM: 0.010% or less, Mg: 0.010% or less, and B: 0.010% or less. Sb is an element that contributes to improving corrosion resistance, and may be contained as required. An Sb content of more than 0.20% is economically disadvantageous because the effect becomes saturated, and Sb fails to produce the effect expected from the increased content. For this reason, Sb, when contained, is contained in an amount of 0.20% or less. When Sb is contained, the Sb content is preferably 0.01% or more. Sn is an element that contributes to improving corrosion resistance, and may be contained as required. A Sn content of more than 0.20% is economically disadvantageous because the effect becomes saturated, and Sn fails to produce the effect expected from the increased content. For this reason, Sn, when contained, is contained in an amount of 0.20% or less. When Sn is contained, the Sn content is preferably 0.01% or more.

At Most 20 of Non-Metallic Inclusions of Oxide Containing Calcium Oxide, CaO, and Aluminum Oxide, $Al_2O_3$, in Steel Having a Composition Ratio Satisfying the Formula (1) Below and a Major Axis of 5 μm or More per 100 $mm^2$ Inclusions containing calcium oxide (CaO) and aluminum oxide ($Al_2O_3$) having a composition ratio satisfying the formula (1) below easily become an initiation site of pitting corrosion in particular, and impair the sulfide stress corrosion cracking resistance. Coarse inclusions having a major axis (largest diameter) of 5 μm or more in these inclusions also easily become an initiation site of sulfide stress corrosion cracking compared to finer inclusions. For this reason, the number of non-metallic inclusions of a calcium oxide CaO— and aluminum oxide $Al_2O_3$-containing oxide having a composition ratio satisfying the formula (1) below and having a major axis of 5 μm or more is limited to at most 20 per 100 $mm^2$, preferably the number is at most 15 per 100 $mm^2$. The number of non-metallic inclusions in steel is determined by the method described in the Examples section below.

$$(CaO)/(Al_2O_3) \geq 4.0 \quad (1)$$

where (CaO) and ($Al_2O_3$) in formula (1) represent the content of CaO and the content of $Al_2O_3$ in the non-metallic inclusions, in mass %.

A steel pipe according to aspects of the present invention is a martensitic stainless steel pipe, and has a microstructure containing a tempered martensitic phase as a primary phase. As used herein, "primary phase" means a phase accounting for at least 70% by volume. A microstructure of a steel pipe according to aspects of the present invention may contain one or two of a retained austenite phase and a delta ferrite phase in at most 30% and at most 5%, respectively, by volume, in addition to the tempered martensitic phase. However, the fractions of retained austenite phase and delta ferrite phase should preferably be reduced as much as possible because the delta ferrite phase causes cracks and defects during pipe making, and the retained austenite phase leads to increase in hardness.

A steel pipe according to aspects of the present invention has a yield stress of 655 MPa or more. The yield stress is preferably 665 MPa or more. The upper limit of yield stress is not particularly limited. However, in view of ensuring sulfide stress corrosion cracking resistance, the yield stress is preferably 896 MPa or less. The yield stress is determined using the method described in the Examples section below.

The following describes a preferred method of manufacture of a stainless steel seamless pipe for oil country tubular goods according to aspects of the present invention.

Aspects of the present invention use a steel pipe (seamless steel pipe) formed from a steel pipe material of the composition described above. However, the method of manufacture of the seamless steel pipe is not particularly limited, and any known seamless steel pipe manufacturing method may be used.

Preferably, a molten steel of the foregoing composition is made using a steelmaking process such as by using a converter, and formed into a steel pipe material, for example, a billet, using a method such as continuous casting or ingot casting-billeting. The steel pipe material is heated, and hot worked into a seamless steel pipe of the foregoing composition using a known tubing process such as the Mannesmann-plug mill process or Mannesmann-mandrel mill process.

The processes after the formation of a seamless steel pipe from a steel pipe material are not particularly limited either. Preferably, the formation of a seamless steel pipe is followed by quenching in which the seamless steel pipe is heated to a temperature equal to or greater than an $A_{c3}$ transformation point, and cooled to a cooling stop temperature of 100° C. or less, and tempering in which the seamless steel pipe is tempered at a temperature equal to or less than an $A_{c1}$ transformation point.

Quenching

In quenching, the seamless steel pipe is heated (reheated) to a temperature equal to or greater than an $A_{c3}$ transformation point, and is cooled to a cooling stop temperature of 100° C. or less, preferably after the heated seamless steel pipe is retained at the temperature (heating temperature) for at least 5 minutes. This enables refinement of the martensitic phase while increasing toughness. When the heating temperature of quenching is below the $A_{c3}$ transformation point, the microstructure does not form a region of a single austenite phase, and a sufficient martensitic microstructure cannot be obtained in the subsequent cooling, with the result that the desired high strength cannot be achieved. For this reason, the heating temperature of quenching is equal to or greater than an $A_{c3}$ transformation point. As an example, the upper limit of heating temperature is 1,000° C. or less, though it is not particularly limited. The retention time at the heating temperature is not particularly limited either. As an example, the retention time is 30 minutes or less. The lower limit of cooling stop temperature is, for example, 5° C. or more, though it is not particularly limited. The cooling method and the cooling rate are not limited. For example, cooling may be achieved by air cooling (a cooling rate of 0.05° C./s or more and 20° C./s or less), or water cooling (a cooling rate of 5° C./s or more and 100° C./s or less).

Tempering

The quenched seamless steel pipe is subjected to tempering. In tempering, the seamless steel pipe is heated to a temperature equal to or less than an $A_{c1}$ transformation point, and, preferably, air cooled after the seamless steel pipe is retained at the temperature (heating temperature) for at least 10 minutes. When the heating temperature of tempering is higher than an $A_{c1}$ transformation point, an austenitic phase occurs, and the desired high toughness and excellent corrosion resistance cannot be provided. For this reason, the heating temperature of tempering is equal to or less than an $A_{c1}$ transformation point. The heating temperature of tempering is preferably 550° C. or more. The retention time at the heating temperature is, for example, 200 minutes or less, though it is not particularly limited. The $A_{c3}$ transformation point (° C.) and $A_{c1}$ transformation point (° C.) can be measured by a Formaster test that gives a temperature history by heating and cooling a test specimen to be measured, and that detects a transformation point from expansive and contractive microscopic displacements.

EXAMPLES

Aspects of the present invention are further described below through Examples.

Molten steels of the compositions shown in Table 1 were made using a converter, and cast into billets (steel pipe materials) by continuous casting. The billet was hot worked into a pipe using a model seamless rolling mill, and cooled by air cooling or water cooling to obtain a seamless steel pipe having an outside diameter of 104 mm and a wall thickness of 17.6 mm.

A test material, obtained by cutting the seamless steel pipe, was subjected to quenching and tempering under the conditions shown in Table 2. A SEM specimen with a cross section orthogonal to the longitudinal axis of pipe was taken from an arbitrarily chosen circumferential location of the quenched and tempered test material.

For three locations one each from the outer surface of the pipe, the center of wall thickness, and the inner surface of the pipe, the SEM specimen was examined for inclusions by SEM observation, and the chemical composition was analyzed using a characteristic X-ray analyzer attached to the SEM (Scanning Electron Microscope). The examination was conducted to calculate how many of the non-metallic inclusions of an oxide containing calcium oxide, CaO, and aluminum oxide, $Al_2O_3$, in the steel are satisfying the formula (1) below and having a major axis of 5 μm or more (the major axis is the largest diameter in a SEM micrograph, and the number of non-metallic inclusions is per 100 $mm^2$).

$$(CaO)/(Al_2O_3) \geq 4.0 \quad (1),$$

where (CaO) and ($Al_2O_3$) in formula (1) represent the content of CaO and the content of $Al_2O_3$ in the non-metallic inclusions, in mass %.

The stainless steel seamless pipe for oil country tubular goods according to aspects of the present invention has a microstructure in which the number of non-metallic inclusions (per 100 $mm^2$) in the steel is at most 20 in all of the three locations. In Table 2, the number of inclusions represents the largest number of non-metallic inclusions from the three locations.

An arc-shaped tensile test specimen was taken from the quenched and tempered test material in such an orientation that the test specimen was parallel to the longitudinal axis of pipe. A tensile test was conducted in compliance with the specifications of the ASTM (American Standard Test Method) E8/E8M to determine tensile properties (yield stress, YS, tensile stress, TS). The $A_{c3}$ point (° C.) and $A_{c1}$ point (° C.) representing $A_{c3}$ transformation point and $A_{c1}$ transformation point, respectively, in Table 2 were measured by conducting a Formaster test for a test specimen (measuring 4 mm in diameter and 10 mm in length) subjected to quenching. Specifically, the test specimen was heated to 500° C. at 5° C./s, and to 920° C. at 0.25° C./s, and was cooled to room temperature at 2° C./s after being retained for 10 minutes. An $A_{c3}$ point (° C.) and an $A_{c1}$ point (° C.) were obtained by detecting the expansion and contraction of the test specimen having this temperature history.

An SSC test was conducted in compliance with NACE TM0177, Method A. In the SSC test, the test specimen was immersed in a 25° C. test solution (a 25 mass % NaCl+0.5 mass % $CH_3COOH$ aqueous solution saturated with 0.1 bar $H_2S$ ($CO_2$ bal.) and having an adjusted pH of 4.0 by addition of $CH_3COONa$) for 720 hours under an applied stress of 90% of the yield stress. The test specimen was considered as having passed the test when it did not have a crack after the test, and having failed the test when the test specimen had a crack after the test. Here, "$CO_2$ bal." means that $CO_2$ is the balance other than $H_2S$.

The results are presented in Table 2. The present examples shown in Table 2 all had a microstructure containing martensite (tempered martensite) as a primary phase.

TABLE 1

| | Composition (mass %) | | | | | | | | | | | |
|---|---|---|---|---|---|---|---|---|---|---|---|---|
| Steel No. | C | Si | Mn | P | S | O | Ni | Cr | Mo | Al | V | N |
| A | 0.0530 | 0.19 | 0.42 | 0.018 | 0.001 | 0.0016 | 3.61 | 12.5 | 0.54 | 0.036 | 0.021 | 0.0220 |
| B | 0.0240 | 0.20 | 0.38 | 0.017 | 0.001 | 0.0021 | 4.45 | 12.8 | 0.94 | 0.016 | 0.014 | 0.0390 |
| C | 0.0200 | 0.18 | 0.37 | 0.016 | 0.001 | 0.0019 | 5.40 | 12.9 | 2.11 | 0.022 | 0.015 | 0.0560 |
| D | 0.0110 | 0.14 | 0.35 | 0.015 | 0.001 | 0.0024 | 6.01 | 12.4 | 2.18 | 0.034 | 0.017 | 0.0057 |
| E | 0.0038 | 0.12 | 0.15 | 0.021 | 0.001 | 0.0030 | 5.98 | 12.1 | 2.02 | 0.032 | 0.035 | 0.0045 |
| F | 0.0760 | 0.21 | 0.26 | 0.012 | 0.001 | 0.0009 | 5.72 | 11.9 | 2.43 | 0.045 | 0.009 | 0.0650 |
| G | 0.0034 | 0.15 | 0.40 | 0.016 | 0.001 | 0.0019 | 7.19 | 11.4 | 1.20 | 0.013 | 0.044 | 0.0084 |
| H | 0.0073 | 0.20 | 0.19 | 0.015 | 0.001 | 0.0022 | 3.49 | 12.5 | 1.80 | 0.025 | 0.058 | 0.0105 |
| I | 0.1100 | 0.25 | 0.36 | 0.012 | 0.001 | 0.0015 | 5.47 | 12.9 | 1.58 | 0.047 | 0.016 | 0.0165 |
| J | 0.0640 | 0.18 | 0.30 | 0.015 | 0.001 | 0.0028 | 8.24 | 12.5 | 1.71 | 0.062 | 0.008 | 0.0064 |
| K | 0.0046 | 0.11 | 0.18 | 0.016 | 0.002 | 0.0022 | 7.08 | 13.2 | 2.36 | 0.036 | 0.001 | 0.0076 |
| L | 0.0089 | 0.17 | 0.42 | 0.015 | 0.001 | 0.0018 | 6.92 | 11.4 | 0.91 | 0.046 | 0.045 | 0.1200 |
| M | 0.0440 | 0.32 | 0.24 | 0.018 | 0.001 | 0.0032 | 6.39 | 13.3 | 2.70 | 0.015 | 0.032 | 0.0113 |
| N | 0.0150 | 0.21 | 0.22 | 0.017 | 0.001 | 0.0011 | 4.43 | 12.1 | 1.42 | 0.058 | 0.044 | 0.0093 |
| O | 0.0056 | 0.20 | 0.41 | 0.019 | 0.002 | 0.0027 | 5.80 | 11.7 | 1.90 | 0.033 | 0.023 | 0.0072 |
| P | 0.0084 | 0.20 | 0.04 | 0.020 | 0.001 | 0.0019 | 6.12 | 12.1 | 2.22 | 0.030 | 0.018 | 0.0087 |
| Q | 0.0120 | 0.19 | 0.25 | 0.035 | 0.001 | 0.0020 | 5.65 | 11.8 | 1.28 | 0.021 | 0.024 | 0.0051 |
| R | 0.0109 | 0.13 | 0.34 | 0.014 | 0.001 | 0.0035 | 6.00 | 12.2 | 2.18 | 0.036 | 0.016 | 0.0068 |
| S | 0.0118 | 0.14 | 0.34 | 0.014 | 0.001 | 0.0021 | 6.01 | 12.5 | 2.19 | 0.034 | 0.019 | 0.0041 |
| T | 0.0117 | 0.13 | 0.33 | 0.015 | 0.001 | 0.0028 | 6.00 | 12.6 | 2.19 | 0.035 | 0.015 | 0.0052 |
| U | 0.0116 | 0.14 | 0.33 | 0.015 | 0.001 | 0.0033 | 6.01 | 12.4 | 2.17 | 0.033 | 0.018 | 0.0076 |

TABLE 1-continued

| Steel No. | Composition (mass %) | | | | | | | Remarks |
|---|---|---|---|---|---|---|---|---|
| | Cu | Co | Ca | Ti | Nb | W | Others | |
| A | 0.02 | 0.03 | 0.0005 | — | — | — | — | Compliant Example |
| B | 0.05 | 0.02 | 0.0006 | — | 0.003 | — | — | Compliant Example |
| C | 0.07 | 0.05 | 0.0006 | 0.002 | — | — | — | Compliant Example |
| D | 0.06 | 0.04 | 0.0012 | 0.112 | — | — | — | Compliant Example |
| E | 0.21 | 0.19 | 0.0017 | 0.092 | — | | Mg: 0.0005 | Compliant Example |
| F | 0.56 | 0.61 | 0.0009 | — | — | 0.32 | B: 0.001 | Compliant Example |
| G | 0.33 | 0.28 | 0.0015 | — | 0.002 | — | REM: 0.0049 | Compliant Example |
| H | 0.22 | 0.30 | 0.0021 | 0.030 | — | 0.05 | Mg: 0.0010 | Compliant Example |
| I | 0.05 | 0.16 | 0.0018 | 0.111 | — | — | — | Comparative Example |
| J | 0.24 | 0.07 | 0.0011 | 0.093 | — | — | — | Comparative Example |
| K | 0.32 | 0.53 | 0.0009 | — | 0.003 | — | — | Comparative Example |
| L | 0.66 | 0.44 | 0.0022 | 0.204 | — | — | — | Comparative Example |
| M | — | 0.05 | 0.0014 | — | — | — | Mg: 0.001, B: 0.001 | Comparative Example |
| N | 0.42 | — | 0.0007 | — | — | — | — | Comparative Example |
| O | 0.52 | 0.56 | 0.0038 | 0.226 | — | — | — | Comparative Example |
| P | 0.08 | 0.09 | 0.0016 | — | — | — | — | Comparative Example |
| Q | 0.22 | 0.25 | 0.0007 | 0.085 | — | — | — | Comparative Example |
| R | 0.04 | 0.03 | 0.0022 | 0.104 | — | — | Ta: 0.03 | Compliant Example |
| S | 0.05 | 0.02 | 0.0023 | 0.109 | — | — | Zr: 0.02 | Compliant Example |
| T | 0.04 | 0.06 | 0.0012 | 0.096 | — | — | Sb: 0.067 | Compliant Example |
| U | 0.08 | 0.05 | 0.0022 | 0.106 | — | — | Sn: 0.069 | Compliant Example |

*Underline means outside of the range of the present invention

The balance is Fe and incidental impurities

TABLE 2

| No. | Steel No. | Quenching | | | | | Tempering | |
|---|---|---|---|---|---|---|---|---|
| | | $Ac_3$ point (° C.) | Heating temp. (° C.) | Retention time(*1) (min) | Cooling stop temp. (° C.) | Cooling method | $Ac_1$ point (° C.) | Heating temp. (° C.) |
| 1 | A | 750 | 920 | 20 | 30 | Air cooling | 655 | 625 |
| 2 | B | 755 | 920 | 20 | 25 | Air cooling | 640 | 600 |
| 3 | C | 755 | 920 | 20 | 25 | Air cooling | 655 | 620 |
| 4 | D | 745 | 810 | 20 | 25 | Water cooling | 635 | 595 |
| 5 | E | 755 | 920 | 20 | 25 | Water cooling | 630 | 565 |
| 6 | E | 760 | 920 | 20 | 25 | Water cooling | 640 | 605 |
| 7 | F | 745 | 840 | 20 | 25 | Water cooling | 660 | 630 |
| 8 | G | 745 | 840 | 20 | 20 | Air cooling | 635 | 580 |
| 9 | I | 745 | 810 | 20 | 20 | Air cooling | 635 | 595 |
| 10 | J | 755 | 920 | 20 | 25 | Air cooling | 655 | 630 |
| 11 | K | 755 | 920 | 20 | 25 | Air cooling | 645 | 625 |
| 12 | L | 745 | 840 | 20 | 25 | Water cooling | 630 | 585 |
| 13 | M | 750 | 920 | 20 | 25 | Water cooling | 660 | 620 |
| 14 | N | 760 | 920 | 20 | 25 | Water cooling | 640 | 600 |
| 15 | O | 745 | 840 | 20 | 25 | Water cooling | 630 | 570 |
| 16 | P | 745 | 810 | 20 | 30 | Air cooling | 655 | 625 |
| 17 | Q | 750 | 920 | 20 | 30 | Air cooling | 640 | 600 |
| 18 | H | 750 | 720 | 20 | 25 | Air cooling | 655 | 620 |
| 19 | R | 750 | 810 | 20 | 25 | Water cooling | 640 | 595 |
| 20 | S | 745 | 810 | 20 | 25 | Water cooling | 640 | 595 |
| 21 | T | 750 | 810 | 20 | 25 | Water cooling | 640 | 595 |
| 22 | U | 745 | 810 | 20 | 25 | Water cooling | 630 | 595 |

| No. | Tempering | | Yield stress YS (MPa) | Tensile strength TS (MPa) | Number of inclusions (per 100 $mm^2$) (*3) | SSC test | Remarks |
|---|---|---|---|---|---|---|---|
| | Retention time(*2) (min) | Cooling stop temp. (° C.) | | | | | |
| 1 | 60 | 25 | 672 | 748 | 1 | Pass | Present Example |
| 2 | 60 | 25 | 806 | 845 | 0 | Pass | Present Example |
| 3 | 30 | 25 | 721 | 789 | 1 | Pass | Present Example |
| 4 | 60 | 25 | 836 | 875 | 2 | Pass | Present Example |
| 5 | 30 | 25 | 851 | 897 | 4 | Pass | Present Example |
| 6 | 30 | 25 | 778 | 814 | 4 | Pass | Present Example |
| 7 | 60 | 25 | 684 | 752 | 5 | Pass | Present Example |
| 8 | 60 | 25 | 840 | 888 | 14 | Pass | Present Example |
| 9 | 60 | 25 | 847 | 889 | 12 | Fail | Comparative Example |

TABLE 2-continued

| | | | | | | | |
|---|---|---|---|---|---|---|---|
| 10 | 60 | 25 | 638 | 725 | 9 | Pass | Comparative Example |
| 11 | 60 | 25 | 640 | 736 | 3 | Pass | Comparative Example |
| 12 | 30 | 25 | 815 | 866 | 15 | Fail | Comparative Example |
| 13 | 30 | 25 | 711 | 780 | 11 | Fail | Comparative Example |
| 14 | 60 | 25 | 802 | 854 | 6 | Fail | Comparative Example |
| 15 | 30 | 25 | 843 | 893 | 49 | Fail | Comparative Example |
| 16 | 30 | 25 | 627 | 697 | 13 | Pass | Comparative Example |
| 17 | 30 | 25 | 798 | 862 | 4 | Fail | Comparative Example |
| 18 | 30 | 25 | 615 | 705 | 10 | Pass | Comparative Example |
| 19 | 60 | 25 | 833 | 869 | 2 | Pass | Present Example |
| 20 | 60 | 25 | 830 | 883 | 2 | Pass | Present Example |
| 21 | 60 | 25 | 840 | 884 | 1 | Pass | Present Example |
| 22 | 60 | 25 | 832 | 875 | 1 | Pass | Present Example |

*Underline means outside of the range of the present invention (*1)Retention time at the heating temperature of quenching (*2)Retention time at the heating temperature of tempering (*3) Number of non-metallic inclusions of an oxide in the steel satisfying the formula (1) $(CaO)/(Al_2O_3 \geq 4.0$ and having a major axis of 5 μm or more per 100 $mm^2$ The stainless steel seamless pipes (martensitic stainless steel seamless pipes) of the present examples all had high strength with a yield stress of 655 MPa or more, and excellent SSC resistance with no cracking occurring under the applied predetermined stress in the predetermined environment containing $H_2S$. In contrast, it was not possible to provide the desired high strength or excellent SSC resistance in Comparative Examples falling outside of the ranges of the present invention.

The invention claimed is:

1. A stainless steel seamless pipe for oil country tubular goods having:

a composition that consists of, in mass %, C: 0.10% or less, Si: 0.5% or less, Mn: 0.05 to 0.50%, P: 0.030% or less, S: 0.005% or less, O: 0.0040% or less, Ni: 3.0 to 8.0%, Cr: 10.0 to 11.9%, Mo: 0.5 to 0.94%, Al: 0.1% or less, V: 0.005 to 0.2%, N: 0.10% or less, Cu: 0.01 to 1.0%, Co: 0.01 to 1.0%, and Ca: 0.0005 to 0.0030%, optionally one or more selected from Nb: 0.50% or less, W: 1.0% or less, Ta: 0.1% or less, Zr: 0.20% or less, REM: 0.010% or less, Mg: 0.010% or less, B: 0.010% or less, Sb: 0.20% or less, and Sn: 0.20% or less, and in which the balance is Fe and incidental impurities;

a microstructure containing non-metallic inclusions of an oxide containing calcium oxide, CaO, and aluminum oxide, $Al_2O_3$, in the steel, wherein a number of the non-metallic inclusions in the steel having a composition ratio satisfying the formula (1) below and a major axis of 5 μm or more is at most 20 per 100 $mm^2$; and a yield stress of 806 MPa or more, $$(CaO)/(Al_2O_3) \geq 4.0 \quad (1),$$

where (CaO) and $(Al_2O_3)$ in formula (1) represent the content of CaO and the content of $Al_2O_3$ in the non-metallic inclusions in the steel, in mass %.

2. The stainless steel seamless pipe for oil country tubular goods according to claim 1, wherein the composition consists of, in mass %, C: 0.10% or less, Si: 0.5% or less, Mn: 0.05 to 0.50%, P: 0.030% or less, S: 0.005% or less, O: 0.0040% or less, Ni: 3.0 to 8.0%, Cr: 10.0 to 11.9%, Mo: 0.5 to 0.94%, Al: 0.1% or less, V: 0.005 to 0.2%, N: 0.10% or less, Cu: 0.01 to 1.0%, Co: 0.01 to 1.0%, and Ca: 0.0005 to 0.0030%, one or two or more selected from Nb: 0.50% or less, W: 1.0% or less, Ta: 0.1% or less, and Zr: 0.20% or less, and optionally one or more selected from REM: 0.010% or less, Mg: 0.010% or less, B: 0.010% or less, Sb: 0.20% or less, and Sn: 0.20% or less, and in which the balance is Fe and incidental impurities.

3. The stainless steel seamless pipe for oil country tubular goods according to claim 1, wherein the composition consists of, in mass %, C: 0.10% or less, Si: 0.5% or less, Mn: 0.05 to 0.50%, P: 0.030% or less, S: 0.005% or less, O: 0.0040% or less, Ni: 3.0 to 8.0%, Cr: 10.0 to 11.9%, Mo: 0.5 to 0.94%, Al: 0.1% or less, V: 0.005 to 0.2%, N: 0.10% or less, Cu: 0.01 to 1.0%, Co: 0.01 to 1.0%, and Ca: 0.0005 to 0.0030%, one or two or more selected from REM: 0.010% or less, Mg: 0.010% or less, B: 0.010% or less, Sb: 0.20% or less, and Sn: 0.20% or less, and optionally one or more selected from Nb: 0.50% or less, W: 1.0% or less, Ta: 0.1% or less, and Zr: 0.20% or less, and in which the balance is Fe and incidental impurities.

4. The stainless steel seamless pipe for oil country tubular goods according to claim 2, wherein the composition consists of, in mass %, C: 0.10% or less, Si: 0.5% or less, Mn: 0.05 to 0.50%, P: 0.030% or less, S: 0.005% or less, O: 0.0040% or less, Ni: 3.0 to 8.0%, Cr: 10.0 to 11.9%, Mo: 0.5 to 0.94%, Al: 0.1% or less, V: 0.005 to 0.2%, N: 0.10% or less, Cu: 0.01 to 1.0%, Co: 0.01 to 1.0%, and Ca: 0.0005 to 0.0030%, one or two or more selected from Nb: 0.50% or less, W: 1.0% or less, Ta: 0.1% or less, and Zr: 0.20% or less, one or two or more selected from REM: 0.010% or less, Mg: 0.010% or less, B: 0.010% or less, Sb: 0.20% or less, and Sn: 0.20% or less, and in which the balance is Fe and incidental impurities.

5. A method for manufacturing the stainless steel seamless pipe for oil country tubular goods of claim 1, the method comprising:

forming a steel pipe material of said composition into a steel pipe;

quenching in which the steel pipe is heated to a temperature equal to or greater than an $A_{c3}$ transformation point, and is cooled to a cooling stop temperature of 100° C. or less; and tempering in which the steel pipe is tempered at a temperature equal to or less than an Act transformation point.

6. A method for manufacturing the stainless steel seamless pipe for oil country tubular goods of claim 2, the method comprising:

forming a steel pipe material of said composition into a steel pipe;

quenching in which the steel pipe is heated to a temperature equal to or greater than an $A_{c3}$ transformation point, and is cooled to a cooling stop temperature of 100° C. or less; and tempering in which the steel pipe is tempered at a temperature equal to or less than an $A_{c1}$ transformation point.

7. A method for manufacturing the stainless steel seamless pipe for oil country tubular goods of claim 3, the method comprising:

forming a steel pipe material of said composition into a steel pipe;

quenching in which the steel pipe is heated to a temperature equal to or greater than an $A_{c3}$ transformation point, and is cooled to a cooling stop temperature of 100° C. or less; and tempering in which the steel pipe is tempered at a temperature equal to or less than an $A_{c1}$ transformation point.

8. A method for manufacturing the stainless steel seamless pipe for oil country tubular goods of claim 4, the method comprising:

forming a steel pipe material of said composition into a steel pipe;

quenching in which the steel pipe is heated to a temperature equal to or greater than an $A_{c3}$ transformation point, and is cooled to a cooling stop temperature of 100° C. or less; and tempering in which the steel pipe is tempered at a temperature equal to or less than an $A_{c1}$ transformation point.

* * * * *